United States Patent [19]

Watanabe et al.

[11] 3,969,211

[45] July 13, 1976

[54] CONTINUOUS APPARATUS FOR ELECTROLYTIC TREATMENT ON A LONG STRUCTURE OF ALUMINUM OR ITS ALLOYS

[75] Inventors: Hiroshi Watanabe; Isao Shimamura, both of Hiratsuka; Norio Murohushi, Yamakita; Masao Abe, Yokohama; Yoshio Ando; Masaaki Takahashi, both of Tokyo, all of Japan

[73] Assignees: Pilot Man-Nen-Hitsu Kabushiki Kaisha; Toyo Giken Kogyo Kabushiki Kaisha, both of Tokyo, Japan

[22] Filed: June 3, 1975

[21] Appl. No.: 583,393

[30] Foreign Application Priority Data

June 8, 1974 Japan ..... 49-65330

[52] U.S. Cl. ..... 204/211; 204/205; 204/206

[51] Int. Cl.[2] ..... C25D 11/02; C25D 11/04

[58] Field of Search ..... 204/38 A, 27, 42, 205, 204/206, 211

[56] References Cited

UNITED STATES PATENTS

| | | | |
|---|---|---|---|
| 893,814 | 7/1908 | Schmitz | 204/206 |
| 2,494,954 | 1/1950 | Mason et al. | 204/206 |
| 3,006,820 | 10/1961 | Berman | 204/206 X |
| 3,522,166 | 7/1970 | Jones | 204/206 |
| 3,632,486 | 1/1972 | Hermann | 204/38 A |
| 3,642,602 | 2/1972 | Schweizerhof | 204/211 |

*Primary Examiner*—John H. Mack
*Assistant Examiner*—A. C. Prescott
*Attorney, Agent, or Firm*—Wenderoth, Lind & Ponack

[57] ABSTRACT

A continuous electrolytic treatment apparatus for anodic oxidation and electrolytic coloring operations on an object such as a strip, wire or foil of aluminum and its alloys, wherein there are provided electric field buffer means which comprises a plurality of self-standing plates of plastic resin or the like having an electrically insulating property. The electric field buffer means are located at least in one zone in the electrolytic cell so that it can serves to effectively buffer concentration of excessive electric current to the interface between the object and the electrolytic solution at the above mentioned zone, thereby preventing burning in the surface of the object or in the oxide film formed thereon during the anodic oxidation treatment and unevenness in coloring of the object during the electrolytic coloring operation due to such current concentration, particularly when treating with a high current density.

13 Claims, 4 Drawing Figures

CONTINUOUS APPARATUS FOR ELECTROLYTIC TREATMENT ON A LONG STRUCTURE OF ALUMINUM OR ITS ALLOYS

BACKGROUND OF THE INVENTION

The present invention relates in general to a continuous electrolytical treating apparatus and particularly to a continuous electrolytical treatment apparatus wherein anodic oxidation and electrolytic coloring operations are performed on aluminum or its alloys. More specifically, this invention pertains to a continuous electrolytical treating apparatus whereby burning and deterioration of the electrolytically treated surfaces of a material such as a strip, wire or foil of aluminum or its alloys caused by concentration of an excessive electric current to the interface between the material to be treated and an anodic oxidation treating solution as well as an electrolytic coloring solution are effectively prevented during such electrolytic treatment.

Since in the conventional electrolytic treatment operation, a strip, wire or foil of aluminum or its alloys is continuously subjected as an anode to electrolytic treatment with a relatively low current density during the formation of an anodic oxide film by the anodic oxidation treatment, or subsequently to the anodic oxide film formation during electrolytic coloring operation, the period required in performing such electrolytic treatment is liable to become long, and also the size of such electrolytic treatment apparatus must invitably be made large. On the other hand, it is also known that when such electrolytic treatment is performed with a high current density, the time required for such electrolytic treatment may be made shorter and the size of such electrolytic cell may also be made smaller, but there occurs burning on the surface of the treated material, and thus it is subject to deterioration.

In this respect, it would be advantageous if an improved apparatus could be provided to overcome the above described concomitant problems. This invention is essentially intended for the provision of an improved apparatus wherein there is provided electric field buffer means in a predetermined zone in an electrolytic cell. This electric field buffer means is so specifically designed that when electrolytic treatment with a high current density is being carried out, excessive electric current is buffered or prevented from concentrating at the interface between a strip, wire or foil of aluminum or its alloys (hereinafter referred to as "strip") and an electrolytic solution particularly when the strip is introduced into or taken out of the electrolytic solution. With the adaptation of such buffer means, there is afforded a supply of an optimum quantity of electric current to the electrolytic system, and consequently the surface of such a strip and the anodic oxide film thereon may be made advantageously free from any burning produced during the electrolytic treatment which could possibly lead to deterioration of the product.

SUMMARY OF THE INVENTION

According to this invention, briefly summarized, there is provided an apparatus for continuous electrolytical treatment of a long structure of aluminum or an alloy thereof including an electrolytic cell, an electrolytic treating solution contained therein, and an electrode, said electrode and the structure constituting an electric circuit and supplied with an electric potential, in which apparatus there is further provided electric field buffer means having a through opening therein for passage of the structure therethrough and being disposed at least in a zone between a position where the structure is introduced into the solution and one edge of the electrode facing that position.

An electrolytic treating apparatus according to the present invention provides the following advantageous features.

1. Since electrolytic treatment can be accomplished within a relatively short period with a high current density, it is economically and effectively advantageous, thus substantially contributing to the reduction of operation and production cost.
2. IA homogeneous quality of the product is obtained, thus contributing to a durability and good appearance of the product.
3. The electrolytic treating apparatus can be made substantially small in size and simple in construction, thus contributing to the reduction of plant cost.

The foregoing advantageous features and details of the present invention, as well as further advantages thereof, will become more apparent from the following detailed description with respect to preferred embodiments of the invention when read in conjunction with the accompanying drawings, in which like parts are designated with like reference numerals.

DETAILED DESCRIPTION

The construction and operation of an electrolytic treating apparatus for anodic oxidation and electrolytic coloring operation according to the present invention will now be described in detail with respect to preferred embodiments thereof in conjunction with the accompanying drawings. It should be understood, however, that the embodiments appearing herein are presented for illustrative purpose only and not in any way for limitations of the scope and spirit of the invention.

Figure 1:
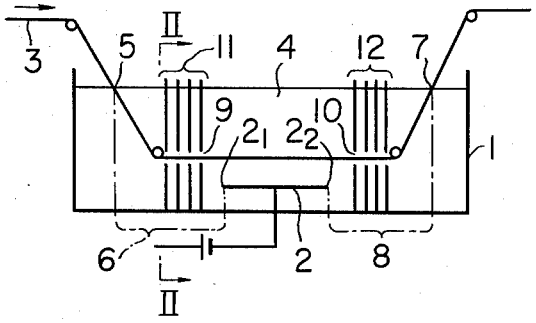
FIG. 1 is a schematic side elevation in longitudinal section showing an anodic oxidation apparatus according to the present invention.

Referring first to FIG. 1, there is shown a first example of a continuous electrolytic treating apparatus according to the present invention, wherein anodic oxide film is formed on the surface of a strip adapted as an anode in the electrolytic cell. In this example, the apparatus comprises an electrolytic cell 1, an electrode 2 of carbon, lead, aluminum, or the like supplied with a direct current (alternating current, or a.c.-superimposed c.d.), a strip 3 uncoiled and supplied from an uncoiler (not shown) and extended along a predetermined path for anodic oxidation treatment through an electrolytic solution 4 for anodic oxidation which is contained in the electrolytic cell 1, and a plurality of electric field buffer plates 11 and 12 having electrically insulating property (e.g., polyvinyl chloride, polyethylene, etc.).

Figure 2:
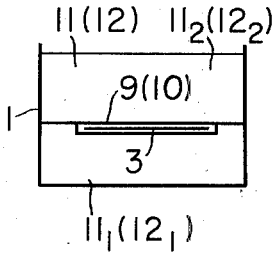
FIG. 2 is a schematic end elevation in transverse section showing the anodic oxidation apparatus according to the present invention.

These buffer plates 11, 12 are arranged in such a manner that the buffer plates 11 are disposed as one separated group in a zone 6 between a position 5 where the strip 3 is introduced into the electrolytic solution 4 and the front edge $2_1$ of the electrode 2 facing that position, and the buffer plates 12 are disposed as the other group in a zone 8 between the rear edge $2_2$ opposite to the above mentioned edge of the electrode 2 and a position 7 where the strip 3 is taken out of the electrolytic solution 4. These buffer plates 11 and 12 are provided for the purpose of effectively buffering the passage of electric current through the electrolytic solution in the cell 1, and for this purpose these buffer plates are positioned with their side and bottom edges generally in close contact with the side walls and the bottom wall of the electrolytic cell 1 and with their upper parts projecting above the surface of the electrolytic solution 4 and are spaced at appropriately equal intervals from each other. In the surface of the buffer plates 11, 12, as best shown in FIG. 2, there are provided slits or elongated openings 9 and 10, respectively, for the purpose of permitting the strip 3 to be introduced and directed to pass therethrough. The elongated openings are formed by providing cut-outs 9 and 10 at the upper edges of lower half parts $11_1$ and $12_1$ of the buffer plates 11 and 12 and placing the upper uncut edges of the lower half parts $11_1$ and $12_1$ in abutment against the straight lower edges of the upper half parts $11_2$ and $12_2$ of the buffer plates 11, 12, respectively.

The strip 3 is now supplied from the uncoiler (not shown) and subjected to successive pretreating processes in such sequence as degreasing, washing with water, etching, washing with water, neutralizing, and washing with water and thereafter is introduced through a power supply cell (not shown) containing an electrolyte therein and into the solution 4 for anodic oxidation operation.

In the position 5 where the strip 3 is introduced into the anodic oxidation solution 4, there occurs concentration of the whole quantity of electric current at theinterface between the strip 3 and the anodic oxidation solution 4 when the strip 3 is introduced into the solution 4. When the strip 3 is treated in the electrolytic solution 4 with a high current density, it is subject to burning on the surface thereof at the position 5, *o* unless there is provided an electric field buffering means such as 11 in the electrolytic cell 1, which burning will inevitably lead to deterioration of the strip surface. Likewise, there occurs concentration of the whole quantity of electric current at the interface between the strip 3 and the solution 4 at the position 7 where the strip 3 with anodic oxide film formed thereon is taken out of the solution 4. Unless there is provided a buffer means such as 12, the strip 3 will undergo burning in the anodic oxide film formed thereon. This burning will result in an unsightly appearance particularly when the strip is subquently treated with electrolytic coloring operation.

In the above described exemplary arrangement of the electrolytic treating apparatus according to the present invention, there are provided two separate groups of electric field buffer plates 11 and 12. Consequently, at the position 5, electric current is effectively prevented from concentrating at the interface between the strip 3 and the solution 4 by the buffering function of the buffer plates 11, so that an appropriate quantity of electric current may be supplied to the electrolytic system, thus effectively forming a desired anodic oxide film on the surface of the strip 3 free from any burning thereon. At the same time, when the strip 3 is taken out of the solution 4 at the position 7, the other group of electric field buffer plates 12 serves to buffer concentration of the whole quantity of electric current, thus supplying an appropriate quantity of electric current to the electrolytic system and preventing the burning in the oxide film formed on the surface of the strip 3.

Tests were made on an anodic oxidation apparatus embodying the invention in comparison with that of the conventional arrangement, and it was observed that the above described design concept was substantiated as follows. In the tests, a strip of aluminum (5005-H4) 0.5 mm thick and a foil of aluminum (1100-H) 0.1 mm thick were treated with an anodic oxidation solution of sulfuric acid 300 g/l at a temperature of 25°C.

When anodic oxidation operation was conducted in the apparatus of the conventional arrangement, i.e., including no electric field buffer means, there occured burning in the shape of a crescent moon on the surface of the aluminum strip and foil with the use of the current density of 7.5 A/dm$^2$. In contrast, when in the case of the anodic oxidation apparatus of the invention, wherein there were provided four pieces each of buffer plates 11 and 12 in two separated groups which were of polyvinyl chloride 5 mm thick and spaced with an interval of 10 mm from each other, and the same electrolytic solution and the same strip and foil were used, no burning was observed even with the use of a current density of 30 A/dm$^2$, and an operation speed of 4 m/min. was possible, which is four times as fast as that of the conventional arrangement.

Figure 3:
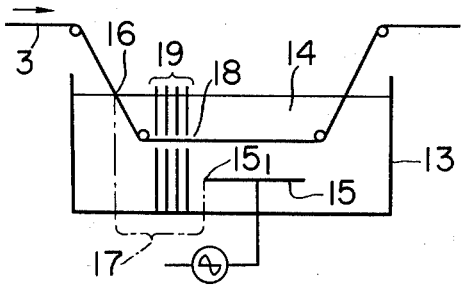
FIG. 3 is a schematic side elevation similar to FIG. 1 showing an electrolytic coloring apparatus according to the invention.

Referring now to FIG. 3, there is shown an electrolytic coloring apparatus constructed according to the present invention, which is designed for the purpose of performing electrolytic coloring operation onto an anodic oxide film formed on the surface of the strip 3. This apparatus comprises an electrolytic cell 13 containing an electrolytic coloring solution 14 therein, an electrode 15 of carbon, lead, nickel or the like supplied with alternating current (or a.c. Superimposed direct current), and a plurality of electric field buffer plates 19 of electrically insulating property (e.g., polyvinyl chloride and polyethylene) disposed in a specific position.

In this embodiment of the invention, the buffer plates 19 are disposed in a zone between a position 16 where the strip 3 is introduced into the solution 14 and the front edge $15_1$ of the electrode 15 facing that position, with the side and bottom edges thereof generally in close contact with the side walls and the bottom wall of the cell 13 and with the upper edge thereof projecting above the surface of the solution 14, and are spaced with an appropriate interval from each other. Each buffer plate 19 is provided at an immersed part thereof with an elongated opening 18 which is designed for the purpose of permitting the strip 3 to pass through the buffer plate. The general construction of the buffer plate 19 is identical to that of the buffer plate 11.

In this electrolytic coloring apparatus, the strip 3 is continuously introduced into the electrolytic solution for coloring the anodic oxide film formed on the surface of the strip. When the strip 3 is introduced into the solution 14, there occurs concentration of the whole quantity of electric current at the interface between the strip 3 and the solution 14 in the position 16 where the strip 3 enters into the solution 14. When electrolytic coloring operation is conducted with a high current density, uneven coloring is observed unless there is provided an electric field buffer means such as 19. When the electrolytic coloring apparatus is equipped with such buffer means, it serves to effect the above mentioned electric field buffering function, thus assuring a uniform color free from any irregularity or unevenness in coloring.

Tests were made on an electrolytic coloring apparatus embodying the present invention in comparison with the conventional arrangement, and it was observed that the above described design concept was met as follows. In the tests, a strip and foil of aluminum with anodic oxide film formed thereon were treated with an electrolytic coloring solution containing stannous sulfate 3 g/l, nickel sulfate 30 g/l, and sulfuric acid 20 g/l at a temperature of 25°C and with a.c. of 15 volts.

When an apparatus of the conventional arrangement, i.e., including no electric field buffer means therein, was used, the strip and foil of aluminum assumed a bronze color with substantial evenness. In contrast, when the apparatus of the invention wherein three pieces of electric field buffer plates of polyvinyl chloride 2 mm thick were disposed in the zone as specified hereinbefore with an interval of 30 mm from each other was used, there was observed electrolytic coloring in bronze color which was completely free from any unevenness in coloring.

In the practical application of the electric field buffer plates according to the present invention to electrolytic treating apparatus such as an anodic oxidation treating cell and an electrolytic coloring cell, the design factors of the electric field buffer plates such as the zone of disposition, material, thickness, quantity, and spacing intervals of the plate elements are selected in accordance with the material to be treated and the electrolytic treating conditions. If the strip is so guided as to be kept away from the buffer plate in the elongated opening thereof so that it will not touch the buffer plate while passing therethrough, the buffer plate may be of any material which has no electrically insulating property.

As an alternative example of the electric field buffer means of this invention, in the case where it has electrically insulating property, it is possible to provide a plurality of contact means in a form such as rollers made of a material of electrically insulating property in such a manner that the plurality of contact means will contact with both surfaces or one surface of the strip between the buffer plate elements while passing therethrough. By the use of contact means of this type, the electric field buffering effect of the buffer plates may be further improved. In general, in order to assure smooth passage of the strip through the buffer plates, the elongated opening therein should be designed to be large enough, but this opening size immediately influences the effect of the electric field buffer plate, i.e., the larger the opening area, the less is the electric field buffering function, and vice-versa. From this consideration, it is preferable to provide contact means for closing or eliminating the elongated opening gap with the strip surfaces so that the effect of the electric field buffer plates will be improved accordingly.

Figure 4:
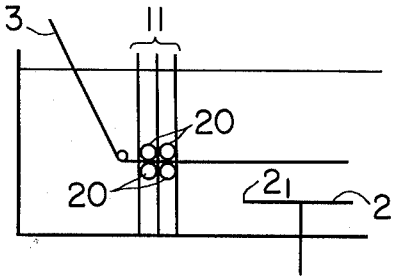
FIG. 4 is a fragmentary schematic side elevation similar to FIG. 1 showing an alternative embodiment of the invention.

Referring now to FIG. 4, there is shown an alternative embodiment of the invention wherein there are provided a plurality of electric field buffer plates 11 of smaller number than that of the foregoing example and a plurality of contact guide means 20 in the form of rollers disposed between the buffer plate elements in the anodic oxidation cell.

Likewise, the provision of such contact means affords a similar effect of electric field buffering when they are installed between the elements of the electric field buffer plate 12 described above, and this effect is also true in the case when the contact means are provided between the elements of the buffer plates 19 in the electrolytic coloring cell described above. The contact means may also be of the type which is not rotatable if the strip can be fed smoothly through the buffer means.

Although detailed description has been made exclusively on the foregoing typical embodiments of this invention, it should be understood, as indicated above, that many changes, variations and modifications with respect to the construction and arrangement in practice thereof may further be derived by those skilled in the art.

What is claimed is:

1. In an apparatus for continuous electrolytical treatment of a long structure of aluminum or an alloy thereof including an electrolytic cell, an electrolytic treating solution contained therein, and an electrode, said electrode and said structure constituting an electric circuit and supplied with an electric potential, the improvement which further comprises electric field buffer means having a through opening therein for passage of said structure therethrough and being disposed at least in one zone between a position where said structure is introduced into the solution and one edge of said electrode facing said position.

2. The improvement as claimed in claim 1 wherein said apparatus is adapted for anodic oxidation operation on said structure, and said electric field buffer means comprises at least one sheet of a self-standing plate and is of dimensions such that the sides and bottom thereof extending toward two side walls and the bottom wall of said cell are generally in close contact therewith, and the upper part of the buffer means projects above the surface of the solution, said buffer means being also disposed in a zone between the edge opposite to said one edge of the electrode and a position where said structure is taken out of the solution.

3. The improvement as claimed in claim 1 wherein said apparatus is adapted for electrolytic coloring operation on said structure with anodic oxide film formed thereon, and said electric field buffer means comprises at least one sheet of a self-standing plate and is of dimensions such that the sides and bottom thereof extending toward two side walls and the bottom wall of said cell are generally in close contact therewith, and the upper part thereof projects above from the surface of the solution.

4. The improvement as claimed in claim 2 wherein said buffer means is of a material having electrically insulating property.

5. The improvement as claimed in claim 3 wherein said buffer means is of a material having electrically insulating property.

6. The improvement as claimed in claim 4 wherein said buffer means is further provided with a plurality of contact guide means extending in parallel to and between said buffer means in the proximity of said opening for slidable contact with two surfaces of said structure thereby to minimize the unoccupied gap area of said opening in the buffer means.

7. The improvement as claimed in claim 5 wherein said buffer means is further provided with contact guide means extending in parallel to and between said buffer means in the proximity of said opening for slidable contact with two surfaces of said structure thereby to minimize the unoccupied gap area of said elongated opening in the buffer means.

8. The improvement as claimed in claim 6 wherein said contact guide means are rollers for rotatably contacting the surfaces of said structure.

9. The improvement as claimed in claim 7 wherein said contact guide means are rollers for rotatably contacting the surfaces of said structure.

10. The improvement as claimed in claim 2 wherein said buffer means is of a material having electrically conducting property and is further provided with contact guide means extending in parallel to and between said buffer means in the proximity of said opening for slidable contact with the surfaces of said structure thereby to minimize the unoccupied gap area of said opening in the buffer means.

11. The improvement as claimed in claim 3 wherein said buffer means is of a material having electrically conducting property and is further provided with contact guide means extending in parallel to and between said buffer means in the proximity of said opening for slidable contact with the surfaces of said structure thereby to minimize the unoccupied gap area of said opening in the buffer means.

12. The improvement as claimed in claim 10 wherein said contact guide means are rollers for rotatably contacting the surfaces of said structure.

13. The improvement as claimed in claim 11 wherein said contact guide means are rollers for rotatably contacting the surfaces of said structure.

* * * * *